US005613766A

United States Patent [19]

Raouf

[11] Patent Number: 5,613,766

[45] Date of Patent: Mar. 25, 1997

[54] ADJUSTABLE LUMINAIRE

[75] Inventor: Sayed Raouf, City of Industry, Calif.

[73] Assignee: Kim Lighting, Inc., City of Industry, Calif.

[21] Appl. No.: 436,906

[22] Filed: May 8, 1995

[51] Int. Cl.[6] ..... F21V 21/00

[52] U.S. Cl. ..... 362/287; 362/147; 362/269; 362/427

[58] Field of Search ..... 362/277, 147, 362/221, 282, 269, 287, 427

[56] References Cited

U.S. PATENT DOCUMENTS

| | | | |
|---|---|---|---|
| 2,782,295 | 2/1957 | Schwenkler | 362/372 |
| 2,928,934 | 3/1960 | Atkin | 362/372 |
| 4,851,970 | 7/1989 | Bronder | 362/269 |
| 5,377,087 | 12/1994 | Yoon | 362/372 |
| 5,386,354 | 1/1995 | Osteen | 362/282 |

*Primary Examiner*—Stephen F. Husar
*Attorney, Agent, or Firm*—Lyon & Lyon

[57] ABSTRACT

An adjustable luminaire is disclosed, comprising a ballast housing and a reflector housing whereby the reflector housing is rotatably movable with respect to the ballast housing. The luminaire also comprises a light source, and preferably comprises a lens and a reflector so that light emitted from the luminaire may be adjusted. The preferred luminaire uses a unique internal clamping mechanism that frictionally attaches the ballast housing and the reflector housing to tighten and seal the luminaire from the elements. The luminaire can be adjusted by turning the head of a screw mounted on the outer surface of the ballast housing.

14 Claims, 5 Drawing Sheets

ADJUSTABLE LUMINAIRE

FIELD OF INVENTION

This application relates to luminaires, and particularly adjustable luminaires for interior or exterior use.

BACKGROUND

Luminaires are generally constructed to distribute light in accordance with the lighting requirements of a particular application. Luminaires are designed to distribute light in both a vertical plane and a horizontal plane. Sometimes it is desirable to have an adjustable luminaire, so that the reflected light pattern in either the vertical plane or the horizontal plane can be adjusted.

Generally, luminaires are designed to take into account a number of consideration and trade-offs, including functionality, aesthetics, cost, mounting location and mounting method, ease of affixation, ease of adjustment, size, weight, etc. In particular, the mounting location and method of installation has an effect on all of the above.

There are a number of ways that adjustable luminaires are mounted and adjusted. The first is a swivel arrangement, whereby the luminaire is attached to a surface or other mounting device using a single swivel mount. This swivel mount is exterior to the luminaire housing and can detract from the visual appeal of the luminaire. Generally, the entire luminaire housing must be moved in order to adjust the light pattern.

A second type of mount uses a yoke assembly, which generally attaches on both sides of the luminaire housing. This suffers from the same visual deficiencies as the swivel mount, and the entire housing generally must be moved to adjust the light pattern.

A third type of luminaire of this type is adjustable internally, whereby the reflector, and possibly other components, are moved internal to the luminaire housing. While visually appealing, this type of luminaire may lack the adjustability of the above devices.

SUMMARY OF THE INVENTION

The present invention provides an improvement on the aforesaid adjustable luminaires by combining an aesthetically pleasing design with simplified geometry which complements the architectural environment within which it is used. The preferred embodiment of the present invention comprises two major assemblies, a ballast housing and a reflector housing. The ballast housing and the reflector housing are movable with respect to each other, thereby providing an adjustable luminaire that does not require an external joint or other adjustment device.

Additionally, the present luminaire improves on previous devices that are internally adjustable, by maintaining the structural integrity and precise fit necessary for all the major optical parts of the luminaire, so that the luminaire can be used in many different applications and can be precisely adjusted.

The preferred embodiment of the current invention combines a reflector housing, which houses most of the optical hardware, and a ballast housing, which can be attached to a wall or other mounting location. The preferred luminaire has an internal clamping mechanism that tightens or loosens the fit between the two housings, thereby allowing them to be rotated with respect to each other. Furthermore, the preferred luminaire has leak resistant seals that allow the luminaire to be used in exterior locations and even be inverted.

Accordingly, it is an object of the present invention to provide an improved adjustable luminaire.

BRIEF DESCRIPTION OF THE DRAWINGS

These and other objects of the present invention will become better understood through a consideration of the following description taken in conjunction with the drawings in which.

DETAILED DESCRIPTION

Figure 1:
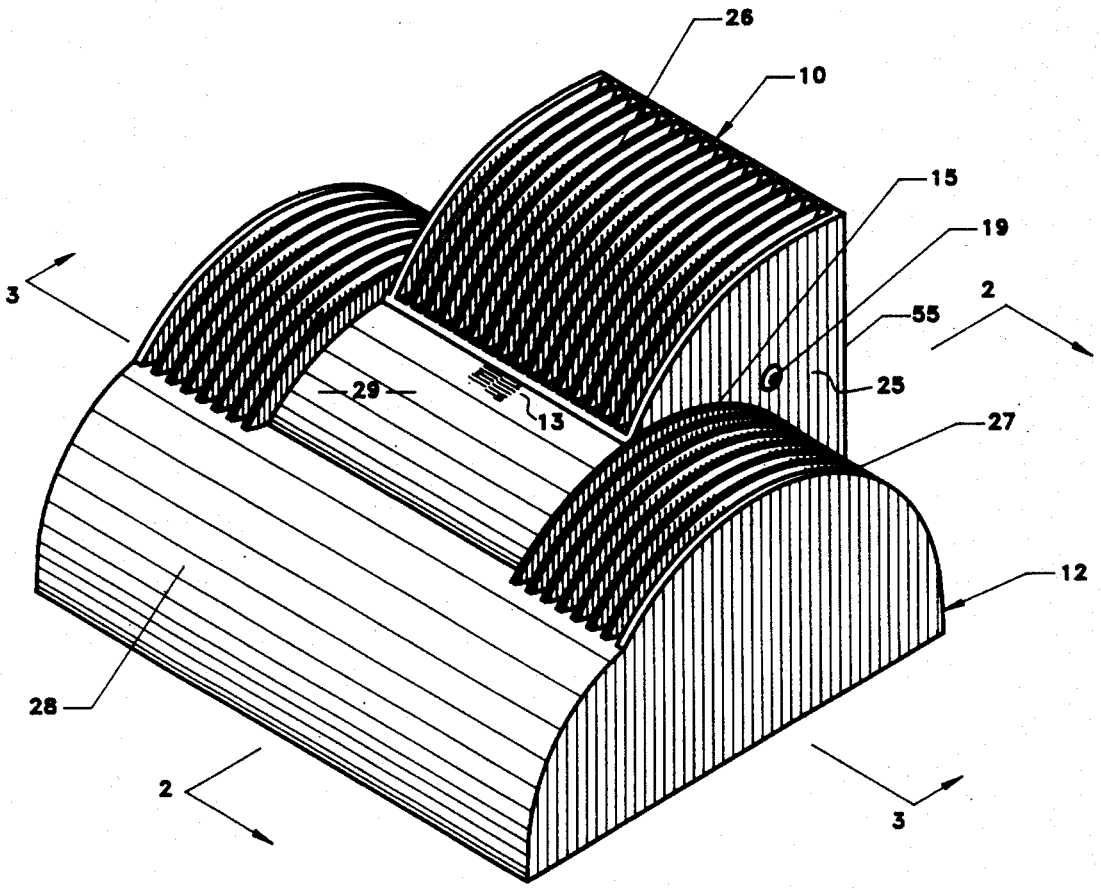
FIG. 1 is a perspective view of the preferred luminaire showing a ballast housing and a reflector housing.
Figure 2:
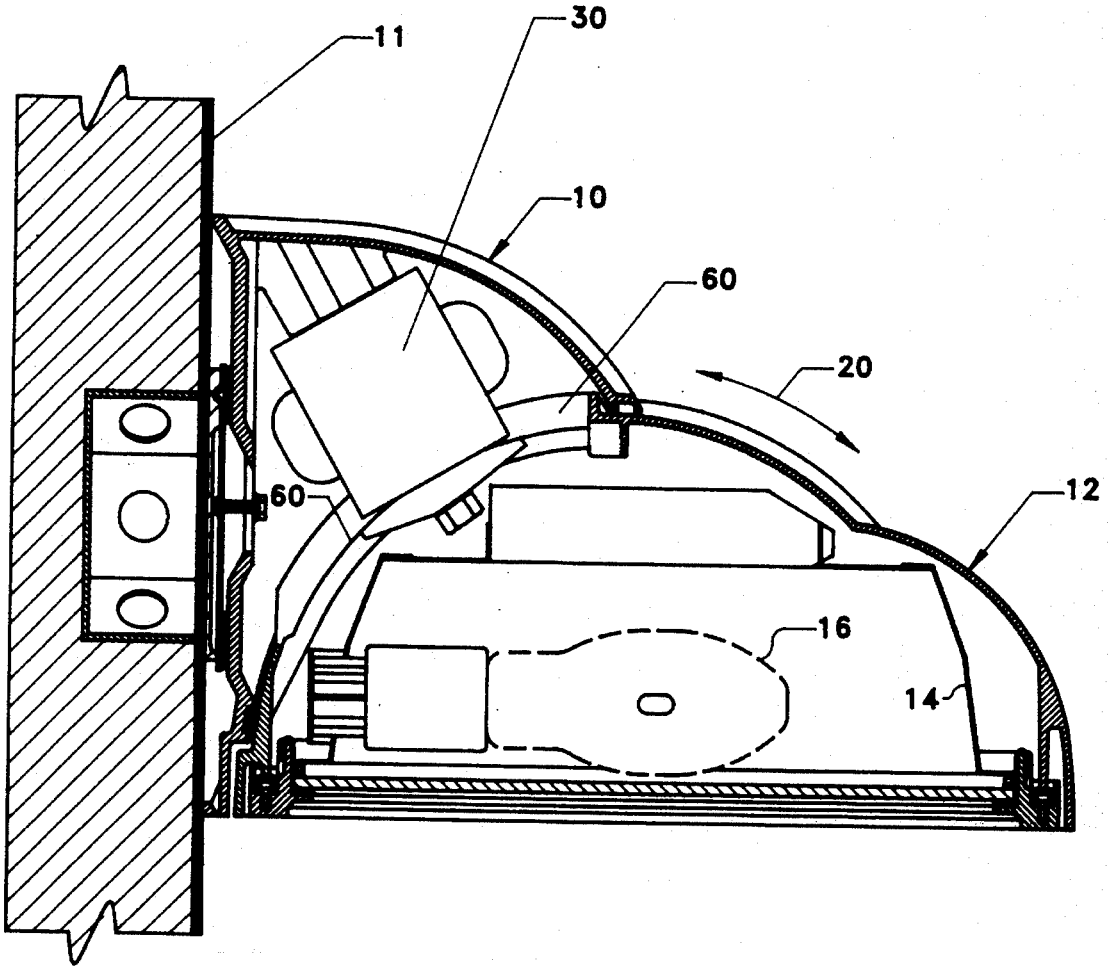
FIG. 2 is a cross-sectional view of the luminaire of FIG. 1, taken along a line 2—2 in FIG. 1, showing the major components of the luminaire and indicating the relative direction of rotation.

Turning now to the drawings, FIG. 1 depicts a preferred adjustable luminaire having a ballast housing 10 and a reflector housing 12. Generally, the ballast housing 10 may be fixedly attached to a surface, such as a wall 11 (as shown in FIG. 2), or other mounting device. The outer surface of the preferred ballast housing 10 has a curved ribbed surface 26, a flat side surface 25, and a generally flat rear surface 55 for attachment to a wall, other surface or mounting device. These three surfaces form a cavity that opens toward a reflector housing 12. The side surface 25 has a lower, arcuate shape 15 that matches the shape of an upper part of the reflector housing 12. The mating of these two surfaces is explained further below and shown at 15 in FIGS. 1, 8 and 8A.

The preferred reflector housing 12 has an upper surface comprising a curved rib surface 27, a curved surface without ribs 29 and a front surface 28. The curved rib surface 27 and the front surface 29 have generally the same arcuate outer shape, as shown at arc 15 in FIGS. 1, 8 and 8A. The curved surface without ribs 29 has a series of markings 13 for indicating the adjustment of the luminaire.

Figure 8:
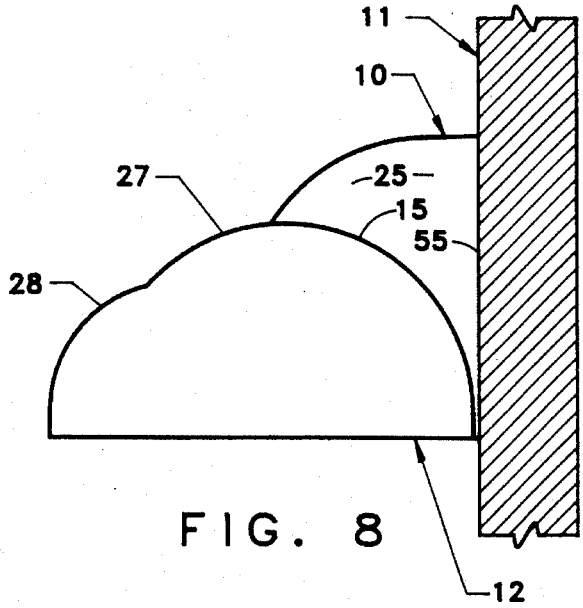
FIG. 8 is a side view of the preferred luminaire, showing the reflector housing in a standard horizontal position with no adjustment.
Figure 8A:
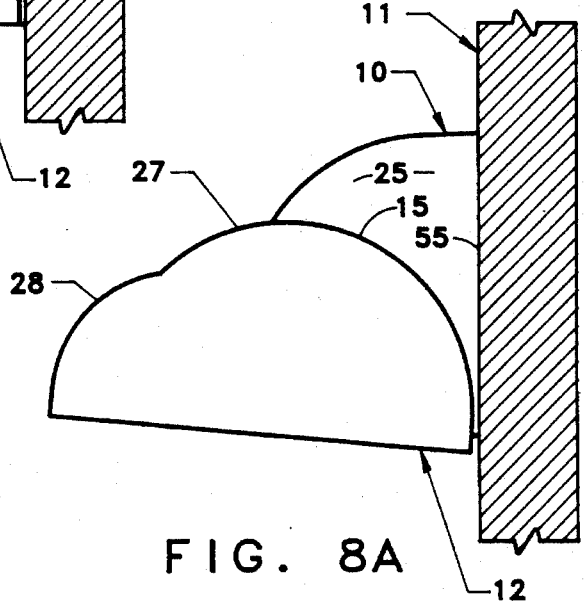
FIG. 8A is a side view of the preferred luminaire, showing the reflector housing adjusted upward.

The preferred reflector housing 12 is designed to rotate with respect to the ballast housing 10 along the arc defined at 15 in FIG. 1. Referring specifically to FIGS. 8 and 8A, the reflector housing may rotate from a standard horizontal position as shown in FIG. 8, to an "up" position as shown in FIG. 8A, with the light from the luminaire generally shining down. This rotation allows the light pattern emitted from the luminaire to be adjusted. The markings 13 indicate the degree of adjustment.

FIG. 2 illustrates a cross-sectional view of the preferred luminaire. It shows the ballast housing 10 attached to a wall surface 11, the reflector housing 12, and a directional arrow 20 indicating the direction of relative movement between each housing. Further, FIG. 2 shows the major optical components housed in the reflector housing 12; a bulb 16 and a reflector 14. The location of a clamping mechanism 30 is illustrated, as explained in detail below and shown in detail in FIGS. 4–7 (in FIG. 2, the actual clamping mechanism is partially obscured by a ballast.) Further, FIG. 2 shows an open cavity 60 between the ballast housing 10 and the reflector housing 12.

The preferred ballast housing 10 and reflector housing 12 are made of aluminum. However, these components preferably can be made of other materials that can withstand the environment that the individual luminaires are subjected to. Further, the shape and outer surfaces of each housing can be varied, as long as there is a common shape between the two (like that shown at 15 in FIG. 1) that allows for tightening them together and sealing them.

Figure 3:
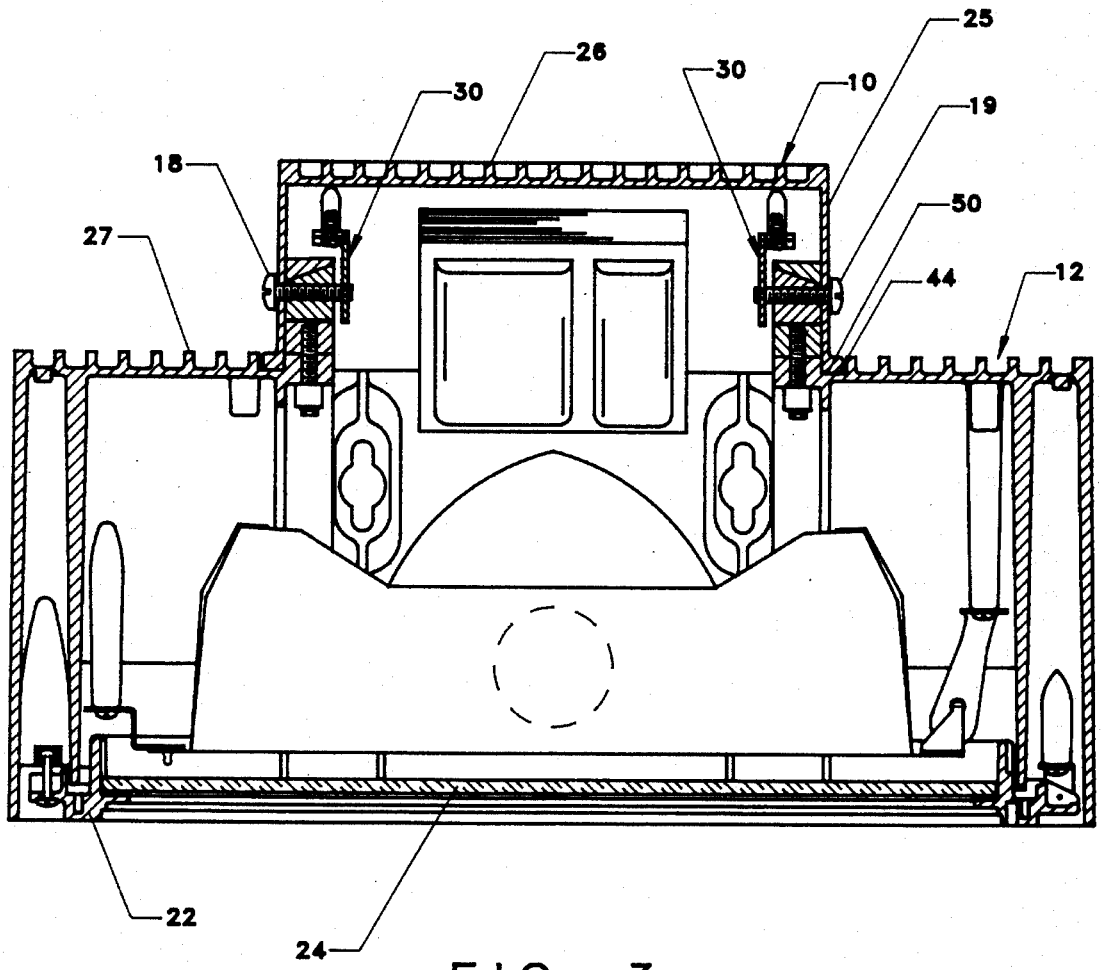
FIG. 3 is a cross-sectional view of the luminaire of FIG. 1, taken along a line 3—3 in FIG. 1, showing the relationship between the housings and a pair of clamping mechanisms.

FIG. 3 shows a cross-sectional view of the preferred luminaire, illustrating the relationship of the ballast housing 10, reflector housing 12, and the clamping mechanism 30. From this perspective, when the reflector housing rotates, the curved rib surface 27 moves perpendicular to the plane of FIG. 3 (either up or down with respect to the drawing). The clamping mechanism 30 acts to draw the ballast housing 10 and the reflector housing 12 together, thus retarding rotation and sealing the two housings. When the clamping mechanism is loosened (as explained below), the reflector housing 12 can be rotated.

Figure 4:
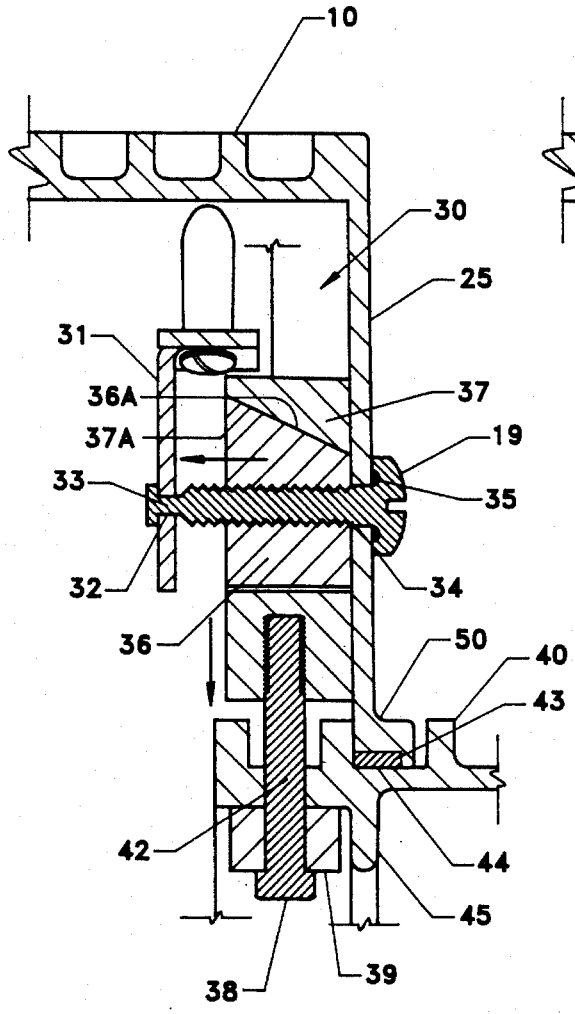
FIG. 4 is a cross-sectional, enlarged view of the preferred clamping mechanism shown on the right side of FIG. 3, showing the device in a "clamped down" mode.
Figure 5:
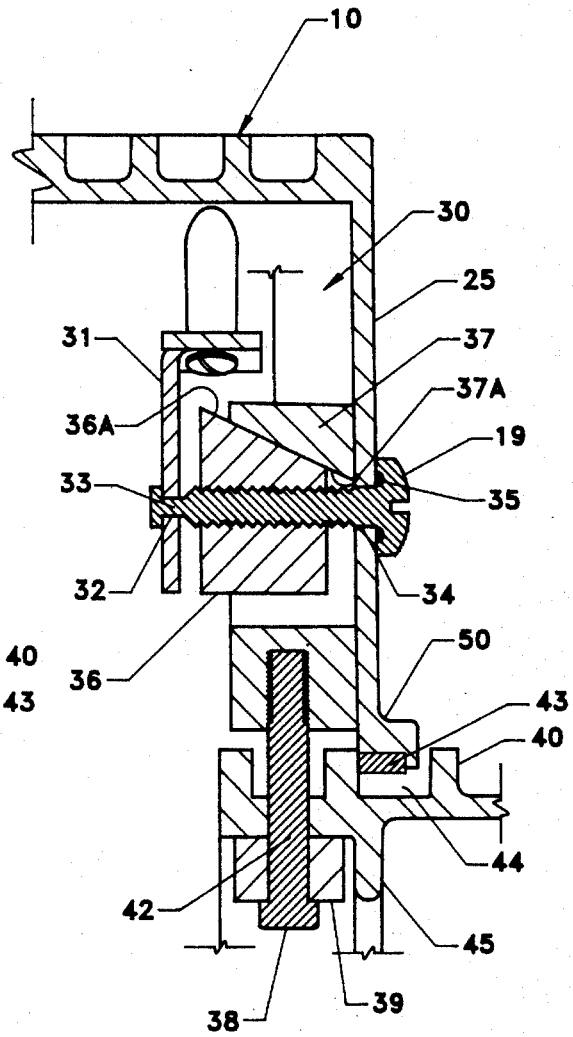
FIG. 5 is a cross-sectional, enlarged view of the preferred clamping mechanism as shown in FIG. 4, showing the device in a "loosened" mode.

The clamping mechanism 30 is shown in further detail in FIGS. 4 and 5, and it serves to tighten or loosen the connection and seal between the two housings 10 and 12. It tightens the seal by applying an upward force on the reflector housing 12, thereby drawing the reflector housing 12 toward the ballast housing 10. The housings intersect at a lower edge 50 of side surface 25 of the ballast housing 10, which moves within a seal channel 44 on the ribbed surface 27 of the reflector housing 12, as shown in FIGS. 3, 4, and 5.

As shown in FIGS. 4 and 5, the preferred clamping mechanism operates generally (details described below) by turning a screw or bolt 19, which horizontally moves a ramp member 36, which in turn moves a block member 37 vertically. This block member 37 is connected by a screw 38 to a clamp member 39, and the clamp member moves the reflector housing 12 vertically so as to tighten and provide a seal with the ballast housing 10.

Specifically, a bracket 31 is fixedly attached to the ballast housing 10. The bracket has an opening 33 to receive the adjustment screw 19. The screw 19 is rotationally mounted between the bracket 31 and the flat side surface 25 of the ballast housing 10. One end of the screw 19 has an annular slot 32 that is received within the opening 33 to allow the screw 19 to rotate without moving in a horizontal direction. The other end of the screw is received in a non-threaded opening 34 in the ballast housing 10, thereby allowing the screw 19 to rotate without moving horizontally. An o-ring seal 35 is seated on the head of the screw 19 to seal out moisture.

The ramp member 36 is threadedly attached to the screw 19. Rotation of the screw 19 causes the ramp member 36 to move horizontally. The direction of movement of the ramp member 36 depends on the direction of rotation of the screw 19. The screw 19 may be adjusted from the exterior of the ballast housing 10 using an allen wrench, screwdriver, or other suitable tool well known in the art. There is no need to open up the housings in order to adjust the luminaire.

Figure 6:
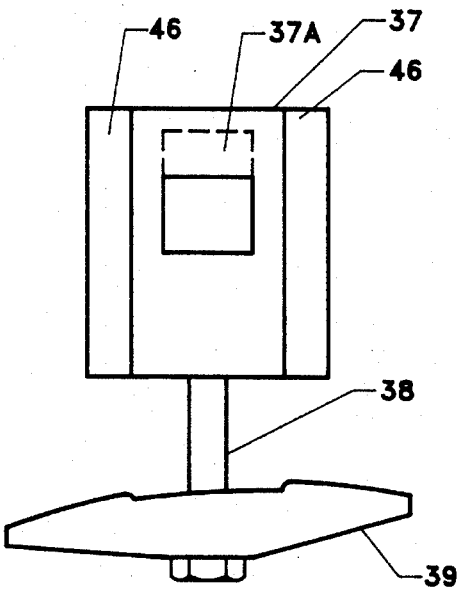
FIG. 6 is a side view of a clamp, block and screw of FIGS. 4 and 5 used for clamping the two housings together.
Figure 7:
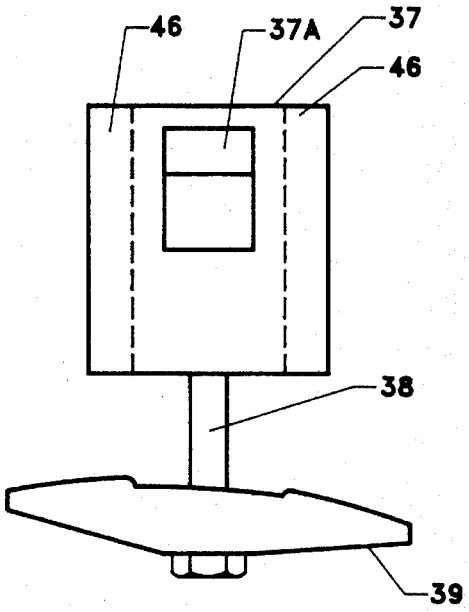
FIG. 7 is a reversed view of the clamp, block and screw shown in FIG. 6.

Horizontal movement of the ramp member 36 forces the block member 37 to move vertically due to the shape of the ramp surface **36*a* and to move vertically due to the shape of the ramp surface other. For example, moving the ramp member 36 to the left allows the block member 37 to move downward, as shown by the arrows in FIG. 4, to loosen the connection between the housings 10 and 12. The block member is attached to a clamp member 39 via a screw 38, as shown in FIGS. 6 and 7. The screw 38 extends through an elongated slot 42 in the reflector housing 12, and the slot 42 extends parallel to the arc 15 shown in FIG. 1, and perpendicular into/out of hte page from FIGS. 4 and 5. The attachment between the screw 38 and the clamp member 39 is loose enough to allow the clamp member 39 a few degrees of movement, as shown by FIGS. 4 and 5. When the block member is moved upward, this tightens the attachment between the two housings by applying an upward force from the clamp member 39 on the reflector housing 12, as shown in FIG. 4. Alternatively, when the block moves downward, this loosens the attachment, as shown in FIG. 5**.

As shown in FIGS. 6 and 7, block member 37 has a pair of flanges 46 that fit into guides (not shown) built into the ballast housing 10 to keep the block member 37 oriented properly. These are used because the block member 37, screw 38 and clamp member 39 are not fixedly attached to any component, but rather are frictionally held between the reflector housing 12, ballast housing 10, and the ramp member 36.

When the clamping mechanism 30 is loosened, as shown in FIG. 5, the reflector housing 12 can be rotated. During rotation, the relative movement of the housings is guided by the lower edge 50 of the side surface 25 that is guided down a channel 44 in the reflector housing 12. The channel 44 is formed by a pair of ribs 40, and has a seal placed between the lower edge 50 and the reflector housing 12 so as to keep out moisture. The forward portion of the ballast housing 10 also has a seal to keep out moisture.

The clamping mechanism components are preferably made from steel or other suitable material, but can alternatively be made of other metals, plastics, or other materials known in the art.

The reflector housing 12 comprises a reflector 14, a light bulb 16 or other light source, a lens frame 22, and a lens 24. The lens 24, lens frame 22, and reflector are preferably attached to the reflector housing 12 so that the angle of light emitted from the luminaire may be varied by rotating the reflector housing 12. The light bulb may be attached to either the ballast housing 10 or the reflector housing 12, as long as the geometry of the reflected light is appropriate. The interface between the lens frame 22 and the lens is sealed to keep out moisture.

While an embodiment of the present invention has been shown and described, various modifications may be made without departing from the scope of the present invention, and all such modifications and equivalents are intended to be covered.

I claim:

1. A luminaire, comprising a ballast housing comprising a curved outer surface, a side surface, a rear surface and an arcuate-shaped lower edge defining a cavity, a reflector housing rotatably mounted with respect to the ballast housing, and having an arcuate-shaped upper surface that is substantially symmetrical to the lower edge of the ballast housing, a light source in said reflector housing, and a clamping mechanism frictionally attached internal to said ballast housing and said reflector housing to tighten and loosen the attachment between said housings, said clamping mechanism comprising a screw rotatably attached to said ballast housing, a ramp member threadedly attached to the screw, a block member frictionally connected to the ramp member, and a clamp member attached to the block member.

2. A luminaire, comprising a ballast housing, a reflector housing rotatably mounted with respect to the ballast housing, a light source in said reflector housing, and a clamping mechanism frictionally attached internal to said ballast housing and said reflector housing to tighten and loosen the attachment between said housings, said clamping mechanism comprising a screw rotatably attached to said ballast housing, a ramp member threadedly attached to the screw, a block member frictionally connected to the ramp member, and a clamp member attached to the block member.

3. A luminaire, comprising a first housing that is adapted for attachment to a wall, a second housing rotatably mounted with respect to said first housing, a light source in said second housing, and a clamping mechanism attached internal to said first housing and said second housing, said clamping mechanism having an external adjustment.

4. The luminaire of claim 3 wherein said first housing has an arcuate-shaped lower edge and said second housing has an arcuate-shaped upper surface that is substantially symmetrical to the shape of the lower edge.

5. The luminaire of claim 3 wherein said clamping mechanism comprises a screw rotatably attached to said first housing, a ramp member threadedly attached to the screw, a block member frictionally connected to the ramp member, and a clamp member attached to the block member.

6. The luminaire of claim 3 wherein said first housing, said second housing, and a sealed lens attached to said second housing define a sealed cavity.

7. A luminaire, comprising a ballast housing, a reflector housing rotatably mounted with respect to said ballast housing, a light source in said reflector housing, and a clamping mechanism attached internal to said ballast housing and said reflector housing, said clamping mechanism having an external adjustment.

8. The luminaire of claim 7 wherein said ballast housing has an arcuate-shaped lower edge and said reflector housing has an arcuate-shaped upper surface that is substantially symmetrical to the shape of the lower edge.

9. The luminaire of claim 7 wherein said clamping mechanism comprises a screw rotatably attached to said ballast housing, a ramp member threadedly attached to the screw, a block member frictionally connected to the ramp member, and a clamp member attached to the block member.

10. The luminaire of claim 7 wherein said ballast housing, said reflector housing, and a sealed lens attached to said reflector housing define a sealed cavity.

11. A luminaire, comprising a ballast housing, a reflector housing rotatably mounted with respect to said ballast housing, a sealed lens mounted proximate said reflector housing, wherein said ballast housing, said reflector housing, and said lens are capable of creating a sealed cavity, a light source in said reflector housing, and a clamping mechanism attached internal to said ballast housing and said reflector housing, said clamping mechanism having an external adjustment.

12. The luminaire of claim 11 wherein said ballast housing has an arcuate-shaped lower edge and said reflector housing has an arcuate-shaped upper surface that is substantially symmetrical to the shape of the lower edge.

13. The luminaire of claim 11 wherein said clamping mechanism comprises a screw rotatably attached to said ballast housing, a ramp member threadedly attached to the screw, a block member frictionally connected to the ramp member, and a clamp member attached to the block member.

14. The luminaire of claim 15 wherein said ballast housing, said reflector housing, and said sealed lens are capable of operating in an inverted position while remaining sealed.

* * * * *